US010343176B2

(12) United States Patent
Hu et al.

(10) Patent No.: US 10,343,176 B2
(45) Date of Patent: Jul. 9, 2019

(54) SHOWER HEAD WITH WATERFALL FUNCTION

(71) Applicant: XIAMEN SOLEX HIGH-TECH INDUSTRIES CO., LTD., Xiamen, Fujian (CN)

(72) Inventors: Youxian Hu, Fujian (CN); Weilong Luo, Fujian (CN); Donghai Chen, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 203 days.

(21) Appl. No.: 15/388,877

(22) Filed: Dec. 22, 2016

(65) Prior Publication Data

US 2017/0320071 A1 Nov. 9, 2017

(30) Foreign Application Priority Data

May 5, 2016 (CN) ..... 2016 2 0399814 U

(51) Int. Cl.

| | |
|---|---|
| ***B05B 1/04*** | (2006.01) |
| ***B05B 1/16*** | (2006.01) |
| ***B05B 1/18*** | (2006.01) |
| ***E03C 1/04*** | (2006.01) |

(52) U.S. Cl.

CPC ..... *B05B 1/044* (2013.01); *B05B 1/1636* (2013.01); *B05B 1/18* (2013.01); *E03C 1/0408* (2013.01)

(58) Field of Classification Search

CPC ..... B05B 1/044; B05B 1/18; B05B 1/185; B05B 1/636; E03C 1/0408

USPC ..... 239/193, 436, 443, 444, 447–449, 553, 239/553.5, 556, 558–562, 567, 568, 239/597–599

See application file for complete search history.

(56) References Cited

U.S. PATENT DOCUMENTS

| | | | | |
|---|---|---|---|---|
| 8,490,894 | B2 * | 7/2013 | Lu | B05B 1/1645 239/394 |
| 8,708,255 | B2 * | 4/2014 | Steffens | B05B 1/1618 239/579 |
| 2005/0205697 | A1 * | 9/2005 | Lo | B05B 1/16 239/592 |
| 2012/0286073 | A1 * | 11/2012 | Zhou | B05B 1/1645 239/548 |
| 2013/0126645 | A1 * | 5/2013 | Zhou | B05B 1/18 239/581.1 |
| 2016/0032570 | A1 * | 2/2016 | Wang | E03O 1/0404 239/592 |

* cited by examiner

*Primary Examiner* — Darren W Gorman
(74) *Attorney, Agent, or Firm* — Rabin & Berdo, P.C.

(57) ABSTRACT

The present invention is provided with a shower head with waterfall function. The shower head includes a shell body, the interior of the shell body is having a waterfall waterway. The shell body is further includes a rectifying passage, one end of the rectifying passage having an inlet, the inlet is connected to the waterfall waterway. The other end of the rectifying passage has an elongated outlet nozzle, and the distance of each point of the outlet nozzle to the inlet are substantially equal, such that water flowing out of the each point of the outlet nozzle has the same flow rate, efficiently delaying the converge of the water and thus lengthening the water curtain.

12 Claims, 6 Drawing Sheets

SHOWER HEAD WITH WATERFALL FUNCTION

FIELD OF THE INVENTION

The present invention relates to a shower head with waterfall function.

BACKGROUND OF THE INVENTION

The outlet functions of a shower head are more and more various, such as massage water, shower water, column water, bubble water, waterfall, etc. the various outlet functions are achieved by disposing different outlets in the shower head, for example, a waterfall is achieved by disposing an elongated outlet nozzle in the cover plate of the shower head, so that water flows out of the outlet nozzle in a sheet shape. However, existing shower head with waterfall function has disadvantages that the water curtain is short, shorter than 50 cm, most waterfall water can only wash the head of the shower user, making the user experience bad.

SUMMARY OF THE INVENTION

The present invention is provided with a shower head with waterfall function, which efficiently lengthening the water curtain, the present invention overcomes the disadvantages of the traditional technology. The technical solution of the present invention is that:

A shower head with waterfall function, comprising a shell body, the interior of the shell body is disposed with a waterfall waterway, wherein the shell body is further disposed with a rectifying passage, one end of the rectifying passage is disposed with an inlet, the inlet is connected to the waterfall waterway, the other end of the rectifying passage is disposed with an elongated outlet nozzle, the distance of each point of the outlet nozzle to the inlet are basically equal.

Compared to the traditional technology, the technical solution of the present invention has following advantages:

1. The distance of each point of the outlet nozzle to the inlet are basically equal, water flowing out of the each point of the outlet nozzle has equal flow rate, efficiently delaying the converge of the water and thus lengthening the water curtain.
2. The rectifying passage is disposed in the water case, the inlet and the outlet nozzle are formed in the two ends of the water case when the water case is injection molded, the size and shape of the outlet nozzle are changeless, efficiently avoiding deformation of the outlet nozzle due to assembly and disassembly.
3. The lateral portion is splay shaped, the side wall of the two guiding blocks faced to each other are inclined disposed to be splay shaped, such to guide the water flowing and increase the width and length of the water curtain.
4. The width of the outlet nozzle is gradually increased form the center to the two sides, thus increasing the water volume at two sides, making the width of the water curtain in accordance with the width of the outlet nozzle, thus lengthening the water curtain.

BRIEF DESCRIPTION OF THE DRAWINGS

The present invention will be further described with the drawings and the embodiments.

DETAILED DESCRIPTION OF THE EMBODIMENTS

Figure 1:
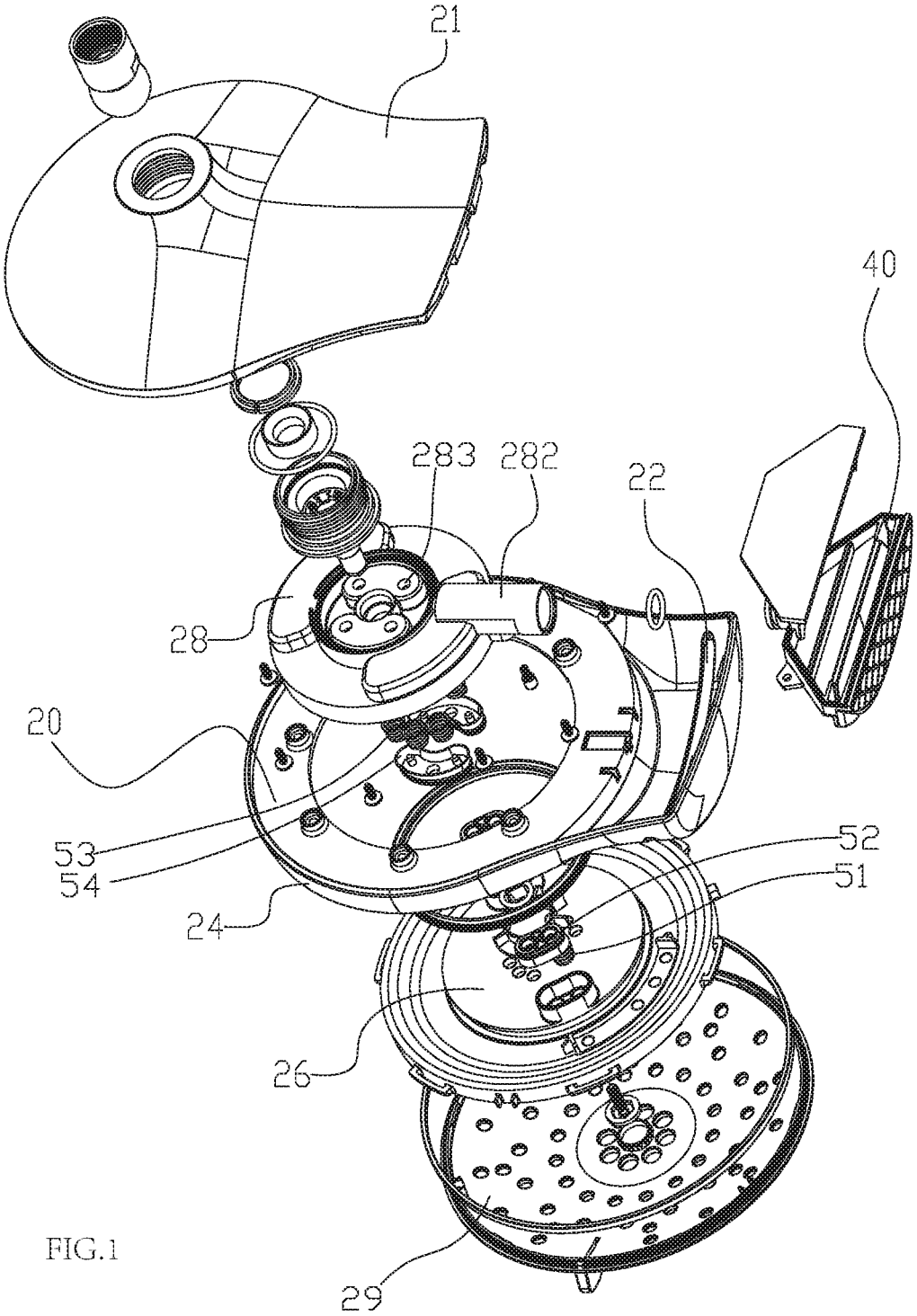
FIG. 1 illustrates an exploded and schematic diagram of the shower head with waterfall function of the present invention.
Figure 2:
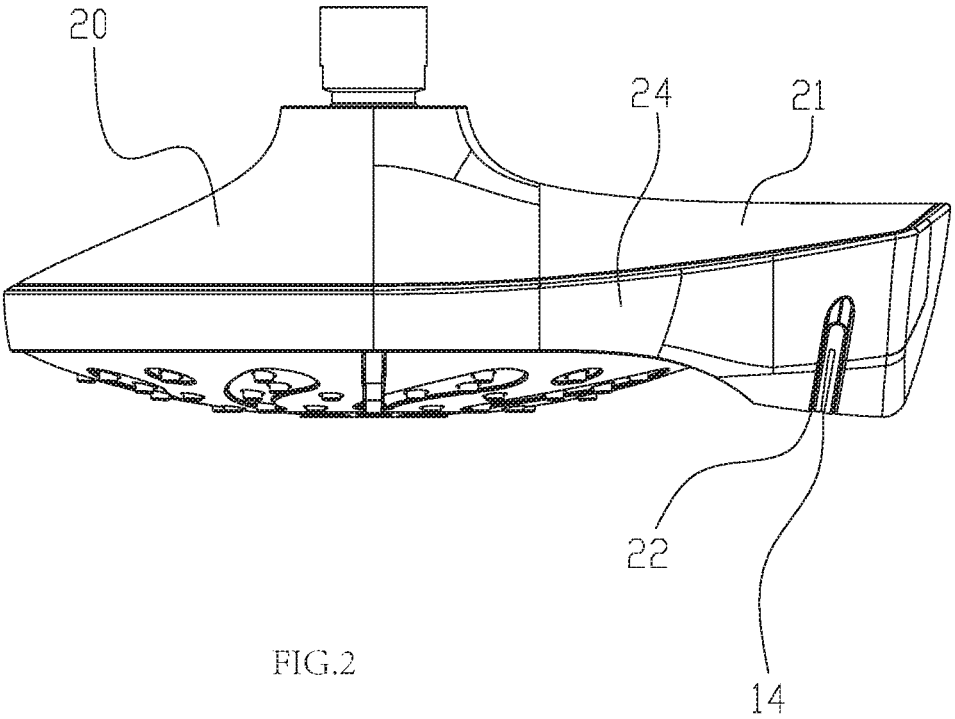
FIG. 2 illustrates a side view of the shower head with waterfall function of FIG. 1.
Figure 3:
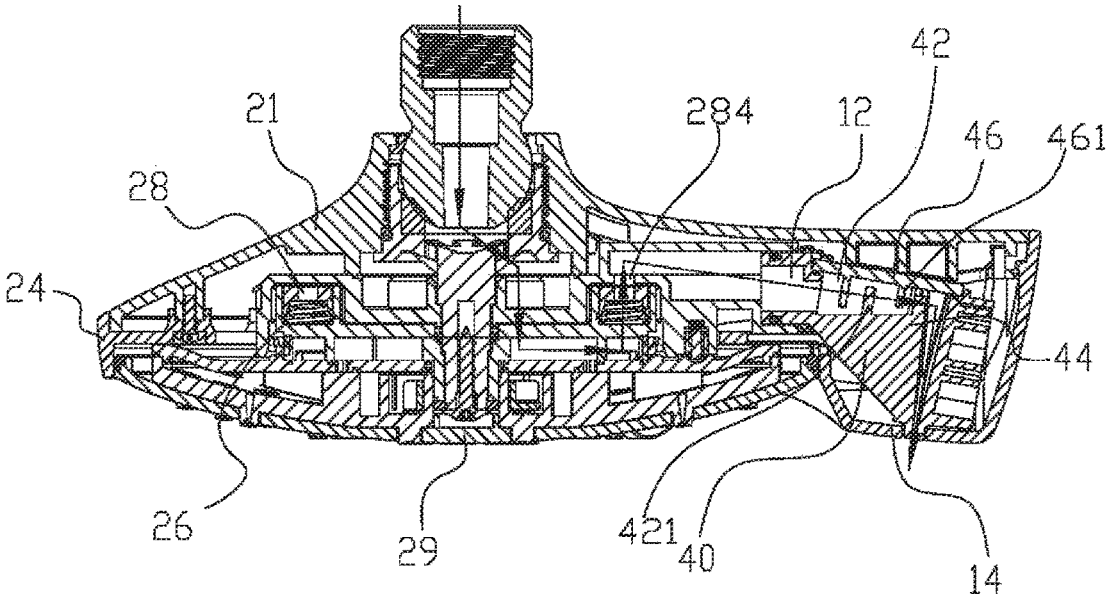
FIG. 3 illustrates a sectional diagram of the shower head with waterfall function of FIG. 1.
Figure 4:
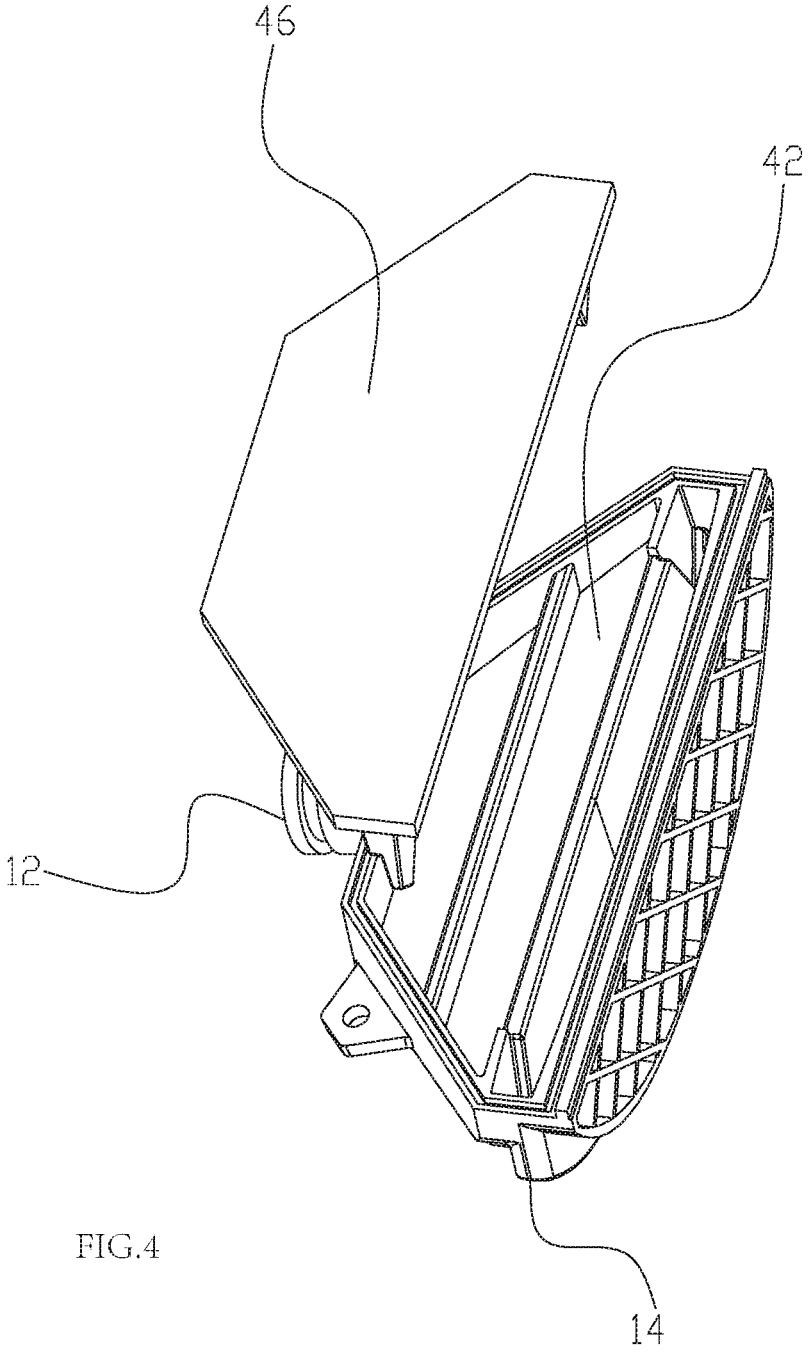
FIG. 4 illustrates a schematic diagram of the lateral portion of the rectifying passage of the shower head of FIG. 1.
Figure 5:
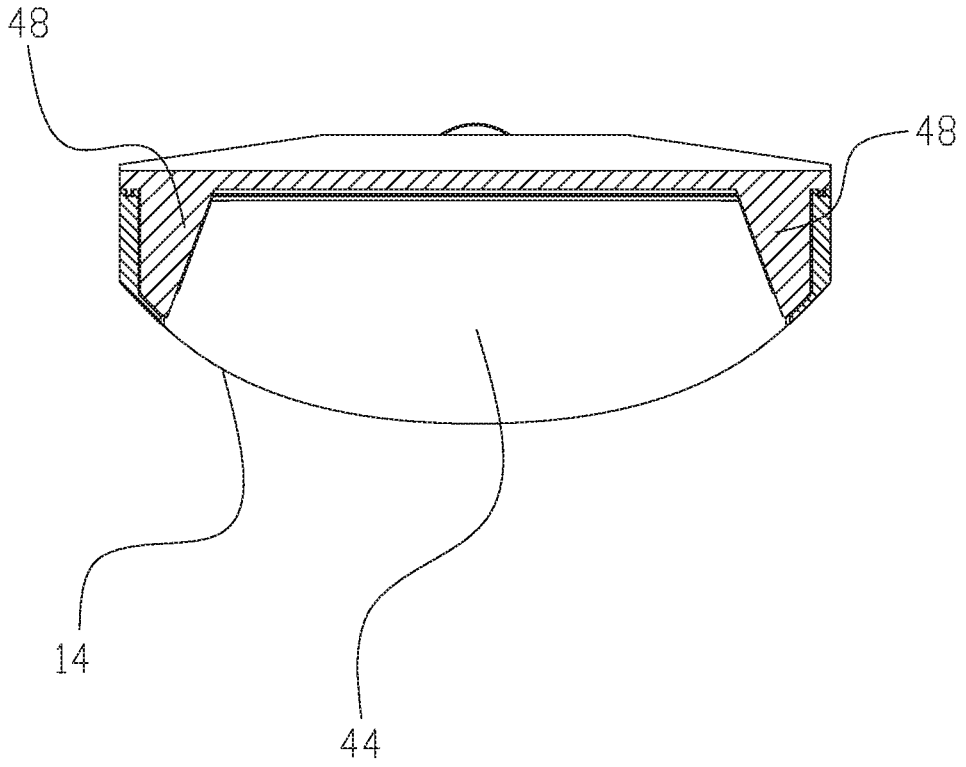
FIG. 5 illustrates a schematic diagram of the longitudinal portion of the rectifying passage of the shower head of FIG. 1.
Figure 6:
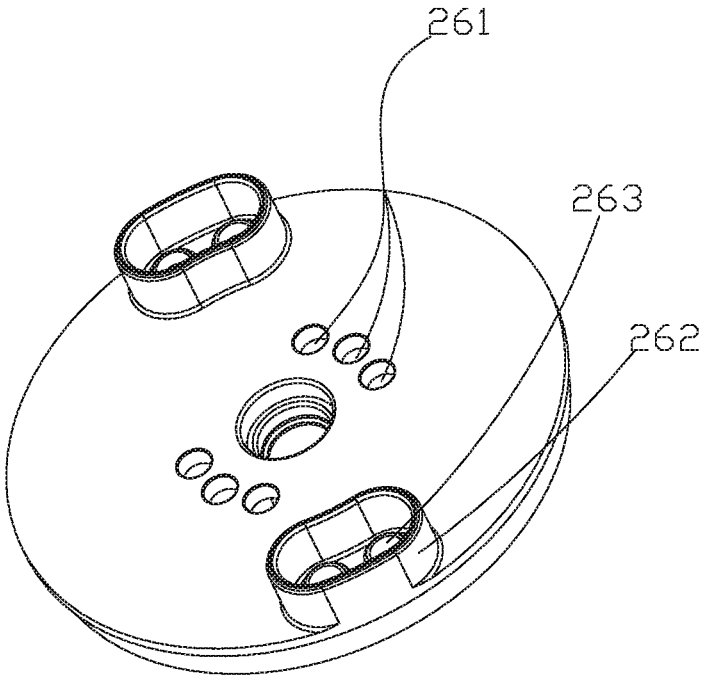
FIG. 6 illustrates a schematic diagram of the water diversion plate of the shower head of FIG. 1.

Referring to FIGS. 1-6, the shower head with waterfall function of the present invention comprises a shell body. The interior of the shell body is disposed with a waterfall waterway and a rectifying passage. One end of the waterfall waterway is connected to the outer water resource, and the other end of the waterfall waterway is connected to the rectifying passage. One end of the rectifying passage is disposed with an inlet 12, and the inlet is connected to the waterfall waterway. The other end of the rectifying passage is disposed with an elongated outlet nozzle 14, and the distance of each point of the outlet nozzle 14 to the inlet 12 are basically equal. When water flows out of the outlet nozzle 14, the flow rate at every position of the outlet nozzle 14 is basically equal, thus greatly reducing the converge time of the waterfall, making the waterfall wide and long, and improving the sense of beauty and the shower experience.

Preferred, the ratio of the maximum distance of the inlet 12 to the outlet nozzle 14 to the shortest distance of the inlet 12 to the outlet nozzle 14 is in a range of 1-1.3; the outlet nozzle 14 is arc shaped; the width of the outlet nozzle 14 is gradually increased from the center to the two ends. The shell body comprises a main body 20 and a water case 40 disposed in the main body. The waterfall waterway is disposed in the main body 20. the rectifying passage is disposed in the water case 40.

The rectifying passage comprises a lateral portion 42 and a longitudinal portion 44. The lateral portion 42 is splay shaped, and the width of the lateral portion 42 is gradually increased from the end connected to the inlet 12 to the other end connected to the longitudinal portion 44. The lateral portion 42 is disposed with two ribs 421 vertical to the flowing direction, the inlet 12 and the outlet nozzle 14 are formed at two ends of the water case 40 when the water case is injection molded, the main body 20 is disposed with an elongated hole 22 corresponding to the outlet nozzle 14, and the outlet nozzle 14 is inserted in to the hole 22. The top surface of the lateral portion 42 of the rectifying passage is open, and a cover 46 covers the top surface of the lateral portion 42. Two sides of the bottom surface of the cover 46 are respectively disposed with a guiding block 48 symmetrically arranged, two guiding blocks 48 are inserted to the longitudinal portion of the rectifying passage, and the side wall of the two guiding blocks facing each other are inclined to form a splay shape. The bottom surface of the cover 46 is disposed with two ribs 461 vertical to the flowing direction, and the two ribs 461 and the two ribs 421 of the lateral portion are staggering arranged. As the two ribs 461 of the cover 46 and the two ribs 421 of the lateral portion 42 of the water case 40 are arranged in staggering way, the ribs slow down the water flowing through the rectifying passage, causing water to fill the chamber formed by the cover 46 and the water case 40. As a result, water can flow out from every point of the outlet nozzle 14 at the same time, and the width of the water flowing out from the outlet nozzle 14 is thus in accordance with the width of the outlet nozzle.

The main body 20 comprises a base 24 and a water diversion plate 26, the water diversion plate 26 is covering on the front portion of the bottom surface of the base 24, the hole 22 is disposed at the rear portion of the bottom surface of the base 24; the water diversion plate 26 is disposed with three sets of inlet holes 261 and two bosses 262, the boss is concaved with two through holes 263, a first spring 51 and a sealing pad 52 are assembled in the through holes 263; two sets of the inlet holes 261 are respectively connected to two shower waterways, the third set of inlet holes 261 are connected to the waterfall waterway. The waterfall waterway is initial from the water diversion plate 26, the waterfall waterway and the shower waterway are switched on and off by rotating the water diversion plate 26. A shower cover plate 29 is fixedly disposed at the lower portion of the water diversion plate to connect to the shower waterway, the water type changes with the rotating of the to water diversion plate. The main body 20 further comprises a fixing base 28 and a top cover 21; the fixing base 28 is rotationally connected with the water diversion plate 26, the top cover 21 locked the fixing base 28 in the base 24. The fixing base is disposed with a connecting pipe 282 and at least an inlet waterway 283, one end of the connecting pipe is disposed with an outlet waterway connected to the water diversion plate, the other end is connected to the inlet 12; the inlet waterway 283 is disposed with a second sealing pad 54 and a second spring 53, the second sealing pad 54 abuts against the water diversion plate under the action of the second spring 53 to close or open the inlet holes 261, such to achieve waterway switch; one end of the connecting pipe 282 is disposed with a groove, the groove is disposed with two through holes 284, the first sealing pad 52 abuts against the groove under the action of the first spring 51 and rotates in the groove to close or open the two through holes 284; water flows from the inlet waterway 283 of the fixing base to the water diversion plate, water flows from the water diversion plate to the connecting pipe 282 of the fixing base 28 and then to the water case 40 to form the waterfall waterway; water flows from the water diversion plate 26 to the shower cover plate 29 directly to form the shower waterway.

Rotating the water diversion plate 26, the shower waterway is open and the waterfall waterway is closed, water from the outer water resource flows from the inlet waterway 283 of the fixing base 28 to the inlet holes 261 of the water diversion plate 26 and then to the shower waterway, and sprays out of the shower cover plate 29 at the bottom portion of the water diversion plate 26.

Rotating the water diversion plate 26, the shower waterway is closed and the waterfall waterway is open, water from the outer water resource flows from the inlet waterway 283 of the fixing base 28 to the third set of the inlet holes 261 and then to the waterfall waterway of the water diversion plate 26, through the water diversion plate 26, the through hole 263, the through hole 284, the fixing base 28 and the connecting pipe 282, and flows to the water case 40, finally flows out of the outlet nozzle 14.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A shower head with waterfall function, comprising:

a shell body including a base and a cover, the base including a first opening in a first surface on a side of the base opposite the cover and a second opening in the first surface on the side of the base opposite the cover; and a water diversion plate in the shell body configured to switch on and off a waterfall waterway and a shower waterway, wherein an interior of the shell body defines the waterfall waterway and a rectifying passage, wherein one end of the rectifying passage includes an inlet, the inlet is connected to the waterfall waterway, and the other end of the rectifying passage includes an elongated outlet nozzle, wherein the elongated outlet nozzle extends through the second opening in the first surface of the base to emit water from the rectifying passage to outside the shell body, and wherein water flowing through the shower waterway is output from the first opening.

2. The shower head with waterfall function according to claim 1, wherein the shell body comprises:

a main body; and a water case disposed in the main body, wherein the waterfall waterway is disposed in the main body, and the rectifying passage is disposed in the water case, and wherein the inlet is formed at one end of the water case and the outlet nozzle is formed at another end of the water case.

3. The shower head with waterfall function according to claim 2, wherein the rectifying passage comprises a lateral portion and a longitudinal portion, the lateral portion connected to the longitudinal portion at a junction, wherein a line between the inlet of the rectifying passage and the junction of the lateral portion and the longitudinal portion defines a first direction, wherein the longitudinal portion extends between the junction and elongated outlet nozzle parallel to a second direction crossing the first direction, wherein the lateral portion has a splay shape, and wherein a width of the lateral portion continuously increases from an end of the lateral portion connected to the inlet to the junction of the lateral portion and the longitudinal portion at an opposite end of the lateral portion.

4. The shower head with waterfall function according to claim 1, wherein the outlet nozzle is arc shaped viewed from the lateral direction, and wherein a width of the outlet nozzle, viewed from a direction crossing the lateral direction, gradually increases from a center of the outlet nozzle to two ends of the outlet nozzle.

5. The shower head with waterfall function according to claim 3, wherein a top surface of the lateral portion of the rectifying passage defined by the water case is open, wherein the water case includes a cover that covers the top surface of the lateral portion, wherein first and second guiding blocks protrude from two opposing sides of a bottom surface of the cover, wherein the two guiding blocks are inserted into the longitudinal portion of the rectifying passage to abut inner walls of the base, and wherein inward-facing surfaces of each of the two guiding blocks are inclined to form a splay shape.

6. The shower head with waterfall function according to claim 5, wherein a bottom surface of the lateral portion defined by the water case includes a first rib vertical to the lateral direction, a top surface of the lateral portion defined by a bottom surface of the cover includes a second rib vertical to the lateral direction, the first rib and the second rib extending longitudinally and arranged in a staggered manner along the lateral direction.

7. The shower head with waterfall function according to claim 1, wherein a ratio of a maximum distance from the inlet to the outlet nozzle to the shortest distance from the inlet to the outlet nozzle along a flow path through the lateral portion and the longitudinal portion is in a range of 1-1.3.

8. The shower head with waterfall function according to claim 2, wherein the water diversion plate covers a front portion of the bottom surface of the base, and wherein the water diversion plate defines a portion of the waterfall waterway, and wherein the waterfall waterway and the shower waterway are switched on and off by rotating the water diversion plate.

9. The shower head with waterfall function according to claim 8, further comprising a shower cover plate at a lower portion of the water diversion plate to connect to the shower waterway.

10. The shower head with waterfall function according to claim 9, wherein the main body further comprises a fixing base, wherein the fixing base is rotationally connected with the water diversion plate, wherein the fixing base is disposed with a connecting pipe and at least an inlet waterway, wherein one end of the connecting pipe includes an outlet waterway connected to the water diversion plate, and another end of the connecting pipe is connected to the inlet, wherein water flows from the inlet waterway of the fixing base to the water diversion plate, water flows from the water diversion plate to the connecting pipe of the fixing base to form the waterfall waterway, and water flows from the water diversion plate to the shower cover plate directly to form the shower waterway.

11. The shower head with waterfall function according to claim 2, wherein the outlet nozzle is arc shaped and a width of the outlet nozzle gradually increases from a center of the outlet nozzle to two ends of the outlet nozzle.

12. The shower head with waterfall function according to claim 3, wherein the outlet nozzle is arc shaped and a width of the outlet nozzle gradually increases from a center of the outlet nozzle to two ends of the outlet nozzle.

* * * * *